US007841906B2

(12) United States Patent
Dent et al.

(10) Patent No.: US 7,841,906 B2
(45) Date of Patent: Nov. 30, 2010

(54) ELECTRICAL CONNECTORS

(75) Inventors: Peter Dent, Bush Hill Park (GB); Paul Hynes, Bushley (GB); John Anderson, Hemel Hempstead (GB)

(73) Assignee: Smiths Group Plc, London (GB)

( * ) Notice: Subject to any disclaimer, the term of this patent is extended or adjusted under 35 U.S.C. 154(b) by 0 days.

(21) Appl. No.: 12/497,303

(22) Filed: Jul. 2, 2009

(65) Prior Publication Data

US 2010/0003866 A1 Jan. 7, 2010

(30) Foreign Application Priority Data

Jul. 4, 2008 (GB) ..... 0812236.8

(51) Int. Cl.
*H01R 24/00* (2006.01)

(52) U.S. Cl. ..... 439/675; 439/843; 439/489

(58) Field of Classification Search ..... 439/675, 439/843, 489
See application file for complete search history.

(56) References Cited

U.S. PATENT DOCUMENTS

| | | | | |
|---|---|---|---|---|
| 3,107,966 | A | 10/1963 | Bonhomme | |
| 3,461,285 | A | 8/1969 | Werner et al. | |
| 3,470,527 | A | 9/1969 | Bonhomme | |
| 3,787,681 | A | 1/1974 | Brunnee et al. | |
| 4,378,499 | A | 3/1983 | Spangler et al. | |
| 4,551,624 | A | 11/1985 | Spangler et al. | |
| 4,593,464 | A * | 6/1986 | Williams et al. | 29/879 |
| 5,083,019 | A | 1/1992 | Spangler | |
| 5,217,391 | A * | 6/1993 | Fisher, Jr. | 439/578 |
| 5,227,628 | A | 7/1993 | Turner | |
| 5,304,797 | A | 4/1994 | Irie et al. | |
| 5,574,277 | A | 11/1996 | Taylor | |
| 5,723,861 | A | 3/1998 | Carnahan et al. | |
| 5,854,431 | A | 12/1998 | Linker et al. | |
| 5,952,652 | A | 9/1999 | Taylor et al. | |
| 6,051,832 | A | 4/2000 | Bradshaw | |
| 6,073,498 | A | 6/2000 | Taylor | |
| 6,102,746 | A | 8/2000 | Nania et al. | |
| 6,225,623 | B1 | 5/2001 | Turner et al. | |

(Continued)

FOREIGN PATENT DOCUMENTS

| | | |
|---|---|---|
| EP | 0135747 | 4/1985 |

(Continued)

*Primary Examiner*—Gary F. Paumen
(74) *Attorney, Agent, or Firm*—Reinhart Boerner Van Deuren S.C.

(57) ABSTRACT

An electrical connector including a first and second assembly that are matable with one another by a sliding push fit to establish electrical interconnection between the two assemblies is disclosed. The first assembly includes a contact pin with a collar extending concentrically around the pin to define a recess therebetween, with the collar supporting on its inner surface a first resilient contact element. The second assembly includes a sleeve open at one end thereof such that the sleeve can be received in the recess of the first assembly, with the sleeve supporting on its inner surface a second resilient contact element. The two assemblies may be arranged such that, when the second assembly is inserted into the first assembly, the first resilient contact element makes sliding electrical contact with an external surface of the sleeve of the second assembly, and the second resilient contact element makes sliding electrical contact with the external surface of the pin of the first assembly.

18 Claims, 5 Drawing Sheets

U.S. PATENT DOCUMENTS

| | | | | |
|---|---|---|---|---|
| 6,239,428 | B1 | 5/2001 | Kunz | |
| 6,442,997 | B1 | 9/2002 | Megerle | |
| 6,459,079 | B1 | 10/2002 | Machlinski et al. | |
| 6,481,263 | B1 | 11/2002 | Haley | |
| 6,495,824 | B1 | 12/2002 | Atkinson | |
| 6,502,470 | B1 | 1/2003 | Taylor et al. | |
| 6,523,393 | B1 | 2/2003 | Linker et al. | |
| 6,825,460 | B2 | 11/2004 | Breach et al. | |
| 7,098,449 | B1 | 8/2006 | Miller et al. | |
| 7,118,712 | B1 | 10/2006 | Manginell | |
| 7,311,566 | B2 | 12/2007 | Dent | |
| 2002/0150923 | A1 | 10/2002 | Malik | |
| 2003/0211772 | A1* | 11/2003 | Chen | 439/489 |
| 2004/0033732 | A1* | 2/2004 | Koch, Jr. | 439/843 |
| 2004/0259265 | A1 | 12/2004 | Bonne | |
| 2005/0017163 | A1 | 1/2005 | Miller et al. | |
| 2005/0095722 | A1 | 5/2005 | McGill et al. | |
| 2005/0161596 | A1 | 7/2005 | Guevremont et al. | |
| 2005/0178975 | A1 | 8/2005 | Glukhoy | |
| 2005/0253061 | A1 | 11/2005 | Cameron et al. | |
| 2006/0063438 | A1* | 3/2006 | Dent | 439/843 |
| 2006/0249673 | A1 | 11/2006 | Breach et al. | |

FOREIGN PATENT DOCUMENTS

| | | |
|---|---|---|
| GB | 2323165 | 9/1998 |
| WO | WO 9301485 | 1/1993 |
| WO | WO 9322033 | 11/1993 |
| WO | WO 9921212 | 4/1999 |
| WO | WO 0079261 | 12/2000 |
| WO | WO 0195999 | 12/2001 |
| WO | WO 02078047 | 10/2002 |
| WO | WO 2004012231 | 2/2004 |
| WO | WO 2006046077 | 5/2006 |
| WO | WO 2008035095 | 3/2008 |

* cited by examiner

ELECTRICAL CONNECTORS

BACKGROUND OF THE INVENTION

Field of the Invention

The present invention relates generally to electrical connectors, and more particularly, but not exclusively, concerned with electrical connectors that can be used in current power applications.

Electrical connectors are available in many different forms. One form of connector has a socket with a hyperboloid arrangement of spring contact wires that make a sliding contact with an inserted male pin element. Such sockets are described, for example, in U.S. Pat. Nos. 3,107,966 and 3,470,527, both to Bonhomme, and in U.S. Pat. No. 6,102,746, to Nania et al., each of which three patents is hereby incorporated herein by reference. These connectors have many advantages such as high reliability and low insertion force. Such connectors are available from Hypertac Limited of London, England and from Hypertronics, Inc. of Hudson, Mass., U.S.A.

Although such sockets are widely used in low power applications, their use in high current applications can present difficulties because the relatively localized contact points leads to high current densities at these points. Also, to ensure close contact of the spring wires with the mating surface of the pin, they need to be relatively stiff, leading to relatively high insertion forces. U.S. Pat. No. 7,311,566, to Dent, which patent is hereby incorporated herein by reference, describes a form of hyperboloid socket connector adapted for use at high power. In this arrangement the female assembly has a plurality of concentric sleeves each supporting hyperboloid spring contacts. The male assembly has a central contact pin surrounded by one or mare concentric collars. The spring contact elements on the female assembly contact the external surface of the pin and the collar or collars when the two assemblies are mated with one another. This arrangement enables the overall contact area to be increased so that current density is reduced.

It is desirable to provide an alternative electrical connector.

SUMMARY OF THE INVENTION

According to one aspect of the present invention, there is provided an electrical connector including a first assembly and a second assembly that are matable with each other by a sliding push fit to establish electrical interconnection between the first and second assemblies. The first assembly includes a male contact pin element and a collar extending concentrically around the pin element and defining a recess therebetween. The collar supports on its inner surface a first resilient contact element.

The second assembly includes a sleeve open at least at one end thereof such that the sleeve can be received in the recess of the first assembly. The sleeve supports a second resilient contact element on its inner surface. The two assemblies are arranged and configured such that when the second assembly is inserted within the first assembly, the first resilient contact element on the inner surface of the collar of the first assembly makes sliding electrical contact with an external surface of the sleeve of the second assembly, and the second resilient contact element in the sleeve of the second assembly makes sliding electrical contact with the external surface of the pin element of the first assembly.

The first resilient contact element preferably includes a plurality of spring contact wires arranged in an hyperboloid configuration. The second resilient contact element also preferably includes a plurality of spring contact wires arranged in an hyperboloid configuration. The electrical connector assemblies are preferably arranged such that the first resilient contact element on the inner surface of the collar of the first assembly makes electrical contact with the external surface of the sleeve of the second assembly before the second resilient contact element in the sleeve of the second assembly makes electrical contact with the external surface of the pin element of the first assembly. The collar of the first assembly is thus preferably longer than the pin element of the first assembly.

The collar and the pin element of the first assembly may be electrically connected with one another within the first assembly, or they may be electrically isolated from one another. If the collar and the pin element are electrically isolated from one another, the pin element may be connected with a sensing circuit responsive to contact with the second assembly. Such a sensing circuit may be arranged and configured to control supply of power to the connector.

According to a second aspect of the present invention, there is provided a first assembly for an electrical connector according to the first aspect of the present invention, and a second assembly for an electrical connector according to the first aspect of the present invention.

DESCRIPTION OF THE DRAWINGS

A connector according to the present invention will now be described, by way of example, with reference to the accompanying drawings, in which.

DETAILED DESCRIPTION OF THE EXEMPLARY EMBODIMENTS

Figure 1:
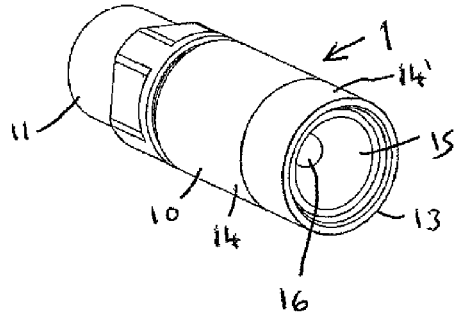
FIG. 1 is an isometric view of a female component or first assembly of an electrical connector constructed according to the teachings of the present invention.
Figure 2:
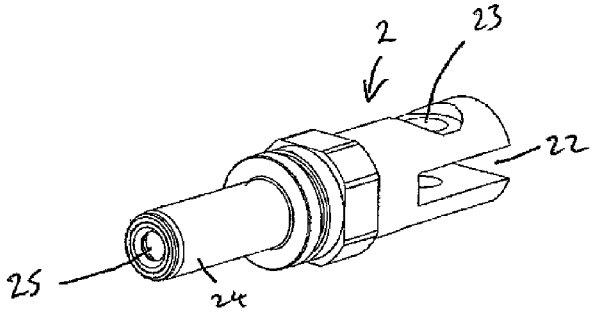
FIG. 2 is an isometric view of a male component or second assembly of an electrical connector constructed according to the teachings of the present invention.

With reference first to FIGS. 1 and 2, a first exemplary electrical connector of the present invention consists of two assemblies, namely a first assembly 1 having a generally female, socket construction and a second assembly 2 having a generally male construction. The second assembly 2 is insertable within the first assembly 1 to establish mating electrical connection between the two parts. The electrical connector of the present invention can be used for any electrical application, but has particular utility in high power/high current applications, typically up to about 1000 Amps.

Figure 3:
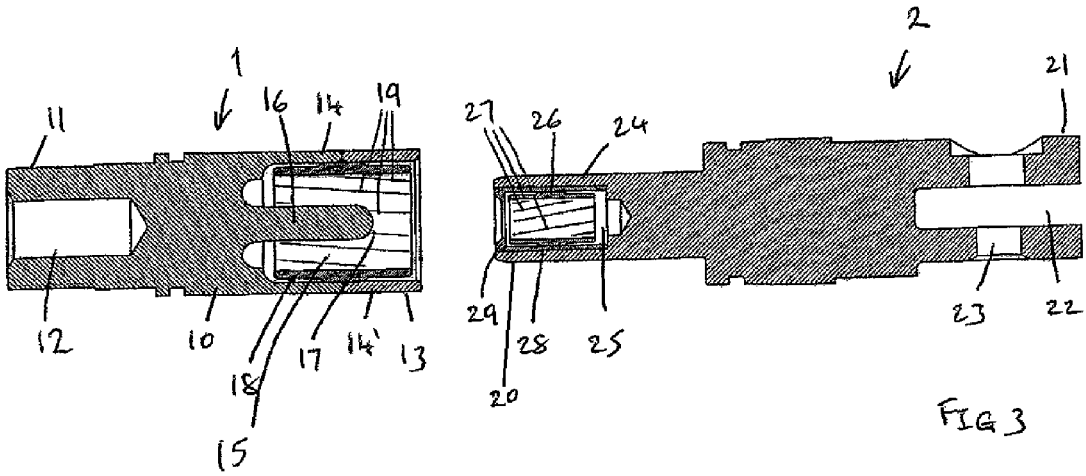
FIG. 3 is a cross-sectional view from the side of the two components of the electrical connector respectively shown in FIGS. 1 and 2 separated from one another.

With reference now also to FIG. 3, the first assembly 1 may be manufactured from a solid metal body 10, which for example may be made of copper, and as shown has a generally cylindrical shape. The body 10 may be plated or otherwise coated with any conventional protective material such as nickel or gold. At a proximal end 11 (shown on the left side of the first assembly 1 in FIG. 3), the body 10 has a short, blind, axial bore 12 or slot or other feature with which the exposed end of a cable or busbar (not shown herein) can be secured. An opposite, distal end 13 of the body 10 (shown on the right side of the first assembly 1 in FIG. 3) is open and provides an outer tubular collar 14 surrounding a recess 15 with its most distal end being formed into a ring 14'.

Figure 4:
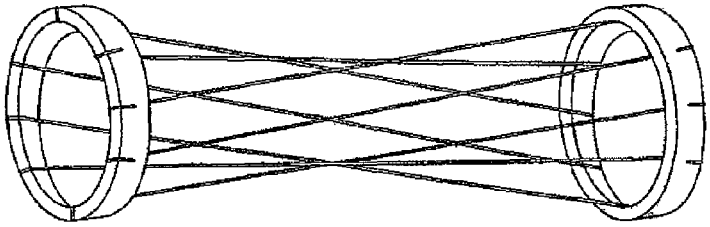
FIG. 4 illustrates a hyperboloid configuration of spring contact wires that may be used in either or both of the components of the electrical connector shown in FIGS. 1 and 2.

Inside the recess 15, the body 10 is formed with a contact element in the form of a solid, male pin 16 extending coaxially within the collar 14 for about two thirds of its length. The pin 16 has a rounded forward end 17 that is recessed from the collar 14 at the open, distal end 13 of the first assembly 1. The pin 16 provides a secondary electrical contact for the first assembly 1 of the electrical connector. The first assembly 1 is completed by a resilient contact element in the form of a hollow, metal, cylindrical component 18 that supports a plurality of metal spring contact wire elements 19 extending generally longitudinally in a hyperboloid configuration, as schematically illustrated in FIG. 4. This provides the primary, outer electrical contact for the first assembly 1 of the electrical connector.

The second assembly 2 may also be manufactured from a metal with a generally cylindrical form, and may, like the first assembly 1, be plated. A proximal end 21 of the second assembly 2 (shown on the right side of the second assembly 2 in FIG. 3) is formed with an axially-extending slot 22 located therein, and has a lateral bore 23 that is used to retain a tang or the like at the end of a cable or busbar (not shown herein) A distal end 20 of the second assembly 2 (shown on the left side of the second assembly 2 in FIG. 3) includes a sleeve 24 that has a smooth cylindrical external surface which provides a sliding contact surface that will fit within the spring contact wire elements 19 located in the cylindrical component 18 of the first assembly 1. This sleeve 24 thus provides a primary electrical contact for the second assembly 2 of the electrical connector.

The distal end of the second assembly 2 is formed with as an axial, cylindrical bore 25 which is open at its most distal end (shown on the left side of the second assembly 2 in FIG. 3) and closed at its opposite end. The bore 25 supports within it a second resilient contact element in the form of a metal cylindrical component 26 that supports a plurality of metal spring contact wire elements 27 extending generally longitudinally in a hyperboloid configuration, as schematically illustrated in FIG. 4.

The cylindrical component 26 and the spring contact wire elements 27 are retained in the bore 25 of the second assembly 2 with a metal outer liner 28 that is formed in two segments and has an inturned retaining lip 29 that is located at its outer, distal end (shown on the left side of the outer liner 28 in FIG. 3). This provides a secondary electrical contact for the second assembly 2 of the electrical connector. The internal diameter of the cylindrical component 26 and locations of the spring contact wire elements 27 in the cylindrical component 26 are such that they will make a sliding contact over the outside of the pin 16 in the first assembly 1.

Figure 5:
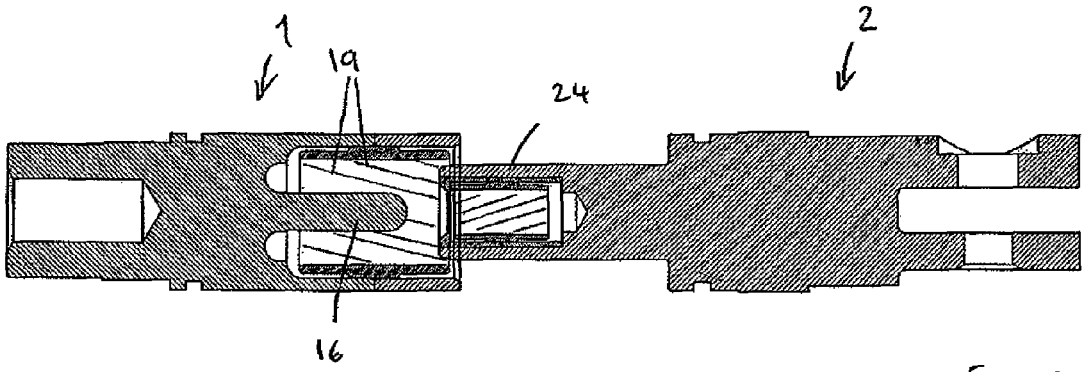
FIG. 5 is a cross-sectional view from the side showing the two components of the electrical connector shown in FIGS. 1 through 3 in initial mechanical and electrical contact.
Figure 6:
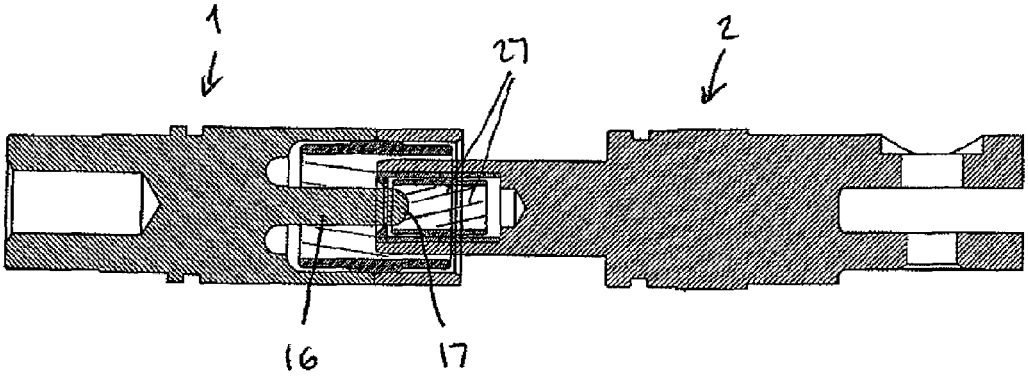
FIG. 6 is a cross-sectional view from the side showing the two components of the electrical connector shown in FIG. 4 approximately half the distance to a fully mated position.
Figure 7:
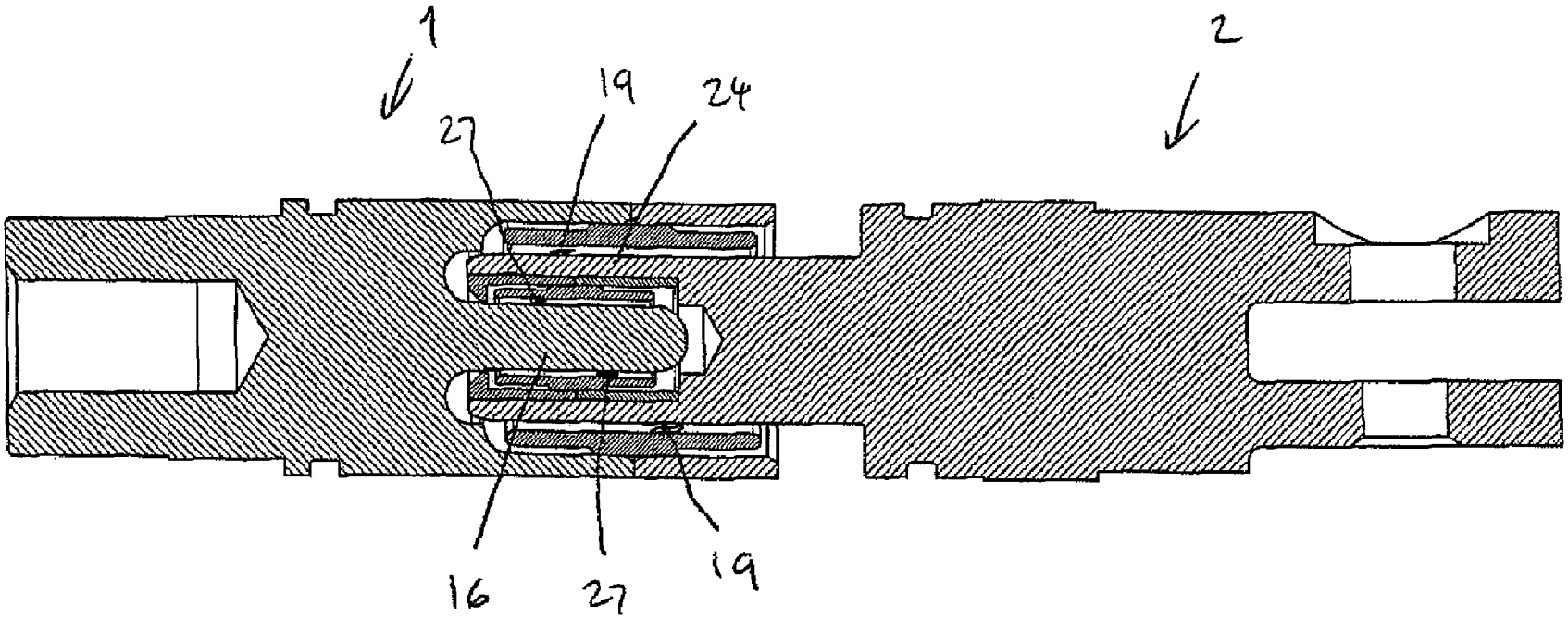
FIG. 7 is a cross-sectional side elevation view showing the two components of the electrical connector in a fully mated position.

FIGS. 5, 6, and 7 illustrate various stages of the mating sequence as the distal end of the second assembly 2 is inserted into the distal end of the first assembly 1.

FIG. 5 shows the initial contact made when the distal end of the sleeve 24 of the second assembly 2, which forms the primary electrical contact thereof, makes initial contact with the primary electrical contact provided by the spring contact wire elements 19 in the first assembly 1. At this stage, there is no contact by any element of the second assembly 2 with the pin 16 of the first assembly 1.

Further insertion of the second assembly 2 into the first assembly 1 causes the spring contact wire elements 27 of the second assembly 2, which form the secondary electrical contact thereof, make initial contact with the forward end 17 of the pin 16 of the first assembly 1, as shown in FIG. 6. This happens when the two halves of the element connector are approximately midway to being fully mated.

FIG. 7 shows the two assemblies 1 and 2 of the electrical connector fully mated, with the spring contact wire elements 27 of the second assembly 2 in full contacting engagement with the outside of the pin 16 of the first assembly 1, and with the distal end of the sleeve 24 of the second assembly 2 in full contacting engagement with the spring contact wire elements 19 of the first assembly 1.

Figure 8:
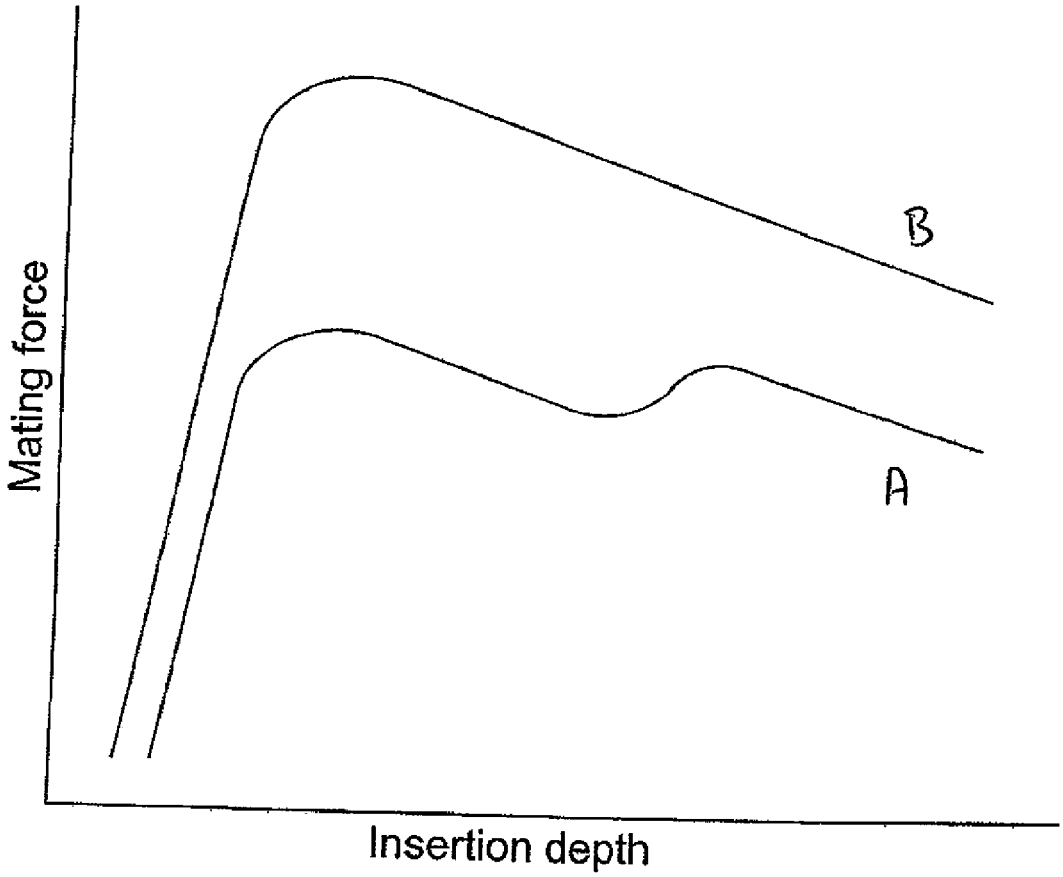
FIG. 8 is a graph comparing the mating force of a conventional prior art electrical connector and an electrical connector that is constructed according to the teachings of the present invention.

It may be observed that, by recessing the pin 16 from the distal end 13 of the first assembly 1 of the electrical connector, there is no initial friction contributed by the pin contact of the electrical connector during mating insertion initially. Therefore, the initial force to achieve mating will be relatively low, increasing only when the two parts become partially mated at which time they are already fully aligned, thereby facilitating correct mating. FIG. 8 depicts the theoretical mating force profile for the connector of the present invention as a line labeled "A." This may be compared to the mating force profile for an equivalent connector employing conventional hyperboloid contacts for the same power rating as a line labeled "B."

It may be seen that the arrangement of the present invention requires an appreciably lower mating force with an improved profile. Compared with conventional hyperboloid electrical connectors of the same size and weight, the electrical connectors of the present invention will have an appreciably increased current handling capability, which may be up to approximately 25% greater. It will be appreciated by those skilled in the art that this feature facilitates the provision of connectors having the same power rating but featuring a smaller size and a lighter weight. The arrangement of the present invention also enables a reduced contact resistance, leading to less power loss and a reduction in ohmic heating in the electrical connector of the present invention.

The electrical connector described above has two contact elements in each part, but those skilled in the art will readily appreciate that it would also be possible to provide connectors with more than two contact elements, such as by the provision of additional concentric sleeves on the two connector assemblies.

The electrical connector described above is of a single-pole kind in that both contact elements are electrically connected with one another within the connector. It would, however, be possible to provide multi-pole connectors according to the present invention by electrically insulating the contact elements from one another. Both the male and female components could thus be multi-pole.

Figure 9:
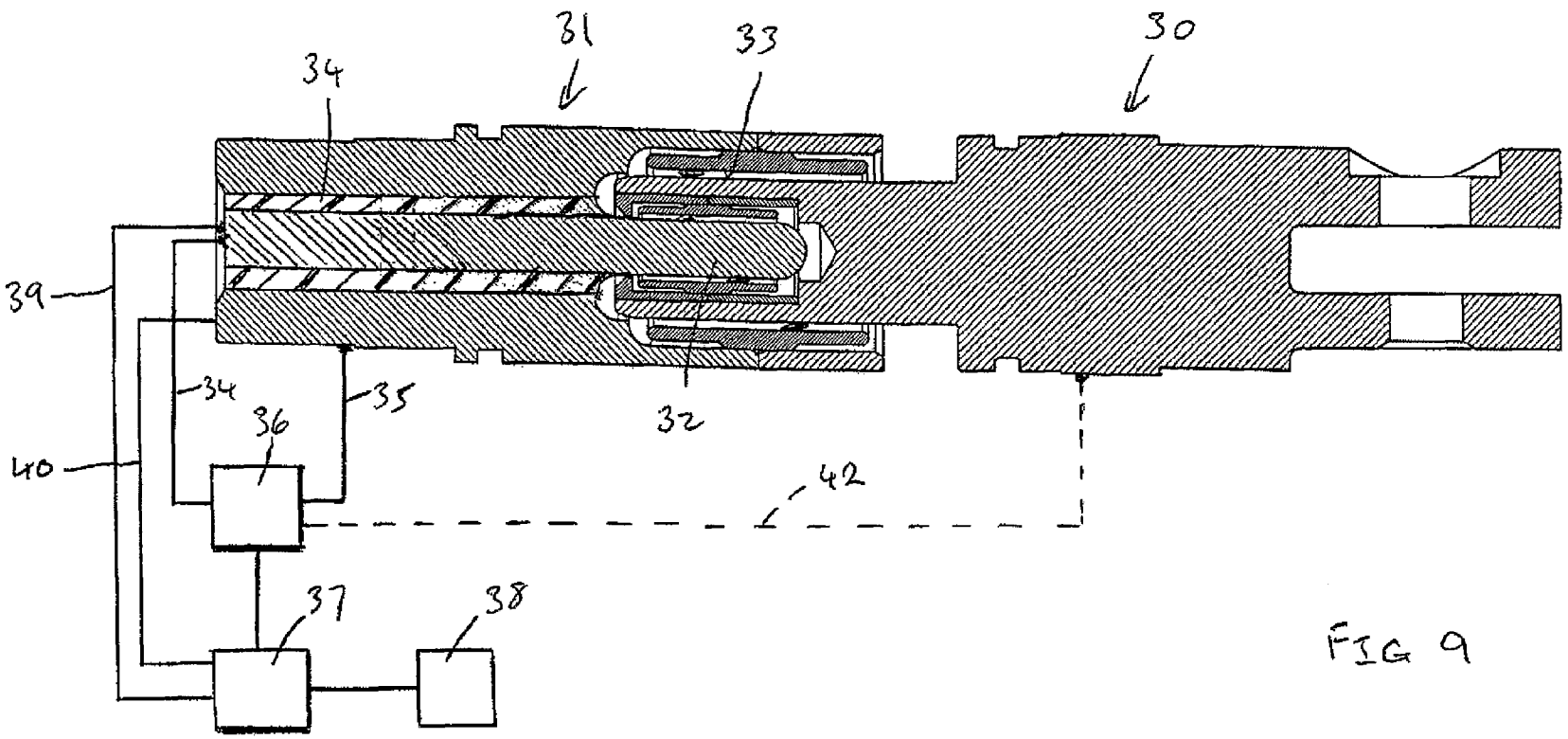
FIG. 9 is a cross-sectional view from the side of a modified electrical connector constructed according to the teachings of the present invention and connected in an electrical circuit.

FIG. 9 illustrates an electrical connector in which a second assembly 30 shown therein is identical in construction to the second assembly 2 described above with reference to FIGS. 1 and 3 to 7, but with a first assembly 31 which differs in construction from the first assembly 1 shown in FIGS. 1 and 3 to 7. The first assembly 31 has its two contact elements 32 and 33 formed from separate components that are electrically isolated from one another by an insulating sleeve 34 made of an electrically nonconductive insulating material.

A pin 32 and an outer contact 33 are respectively connected by wires 34 and 35 to a sensing circuit 36. The sensing circuit 36 is responsive to the resistance between the pin 32 and the outer contact 33, that is, whether they are an open-circuit or a short-circuit. The sensing circuit 36 is connected to and controls operation of a relay 37 that is electrically connected in series between a power supply 38 and two cables 39 and 40 that are respectively electrically connected to the pin 32 and the outer contact 33.

In operation, initially with the two assemblies 31 and 32 of the electrical connector separated from one another, the sensing circuit 36 detects an open circuit between the pin 32 and the outer contact 33, and this causes the relay 37 to remain open and block the flow of electrical power to the first assembly 31. When the second assembly 30 is inserted into the first assembly 31 sufficiently far to bridge the pin 32 and the outer contact 33, the sensing circuit 36 detects the drop in resistance between the pin 32 and the outer contact 33 and triggers the relay 37 to cause it to close, thereby allowing power to flow from the power supply 38 to the pin 32 and the outer contact 33 of the first assembly 31.

In this manner, power will only be applied when the two assemblies 30 and 31 of the electrical connector are at least partially inserted within one another, thereby reducing the risk of external arcing. There are other manners of detecting mating of the two assemblies 30 and 31, such as, for example, by monitoring the resistance between the two assemblies 30 and 31 of the connector. This may be accomplished using a wire depicted by the broken line 42 between the sensing circuit 36 and the second assembly 30. This may be used to stagger the supply of power to the first assembly 31, or to stagger supply to the pin 32 and the outer contact 33 of the first assembly 31 in response to contact between the second assembly 30 and different ones of the contact elements of the first assembly 1.

Although the connector is described herein as having hyperboloid configurations of the spring contact wire elements 19 and 27, those skilled in the art will realize that it would also be possible to provide an electrical connector of a similar design with alternative resilient electrical contact element.

Although the foregoing description of the electrical connector of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. An electrical connector comprising:

first and second assemblies that are matable with one another by a sliding push fit to establish electrical interconnection between the first and second assemblies;

wherein the first assembly comprises:

a male contact pin element; and a collar extending concentrically around the pin element to define a recess therebetween, wherein the collar supports on its inner surface a first resilient contact element; and wherein the second assembly comprises:

a sleeve open at an end thereof such that the sleeve can be received in the recess of the first assembly, wherein the sleeve supports on its inner surface a second resilient contact element;

wherein the two assemblies are arranged such that, when the sleeve of the second assembly is inserted within the recess of the first assembly, the first resilient contact element makes sliding electrical contact with an external surface of the sleeve of the second assembly and the second resilient contact element makes sliding electrical contact with the external surface of the pin element of the first assembly.

2. The electrical connector defined in claim 1, wherein the first resilient contact element comprises:

a plurality of spring contact wire elements.

3. The electrical connector defined in claim 2, wherein the plurality of spring contact wire elements are arranged in a hyperboloid configuration.

4. The electrical connector defined in claim 1, wherein the second resilient contact element comprises:

a plurality of spring contact wire elements.

5. The electrical connector defined in claim 2, wherein the plurality of spring contact wire elements are arranged in a hyperboloid configuration.

6. The electrical connector defined in claim 1, wherein the electrical connector is arranged and configured such that the first resilient contact element in the collar of the first assembly makes electrical contact with the sleeve of the second assembly before the second resilient contact element in the sleeve of the second assembly makes electrical contact with the pin element of the first assembly.

7. The electrical connector defined in claim 6, wherein a distal end of the pin element of the first assembly is recessed within the collar of the first assembly with respect to a distal end of the collar.

8. The electrical connector defined in claim 1, wherein the collar of the first assembly and the pin elements of the first assembly are electrically connected with one another within the first assembly.

9. The electrical connector defined in claim 1, wherein the collar of the first assembly and the pin element of the first assembly are electrically isolated from one another.

10. The electrical connector defined in claim 9, wherein the pin element of the first assembly is connected with a sensing circuit that is responsive to contact of the first assembly with the second assembly.

11. The electrical connector defined in claim 10, wherein the sensing circuit is arranged and configured to control a supply of power to the electrical connector.

12. An electrical connector comprising:

a first assembly comprising:

a pin element;

a collar extending concentrically around the pin element;

a first resilient contact element supported on an inner surface of the collar; and a recess located between the collar and the pin element; and a second assembly comprising:

a sleeve open at an end thereof;

a second resilient contact element supported on an inner surface of the sleeve;

wherein the first assembly and the second assembly are mutually arranged and configured such that the first assembly and the second assembly are mutually engageable with the sleeve of the second assembly being received in the recess of the first assembly with the first resilient contact element of the first assembly contacting the sleeve of the second assembly and the second resilient contact element of the second assembly contacting the pin element of the first assembly.

13. The electrical connector defined in claim 12, wherein at least one of the first resilient contact element and the second resilient contact element comprises:

a plurality of spring contact wire elements.

14. The electrical connector defined in claim 13, wherein the plurality of spring contact wire elements are arranged in a hyperboloid configuration.

15. The electrical connector defined in claim 12, wherein, when the first assembly and the second assembly are being engaged, the first resilient contact element makes contact with the sleeve before the second resilient contact element makes contact with the pin element.

16. The electrical connector defined in claim 12, wherein the pin element is recessed within the collar.

17. The electrical connector defined in claim 12, wherein the first assembly and the second assembly are arranged and configured to reduce the insertion force required to initially insert the second assembly into the first assembly.

18. The electrical connector defined in claim 12, wherein the first assembly and the second assembly are respectively arranged and configured to ensure that, when the first assembly and the second assembly are being engaged, the pin element will always be aligned with the second resilient contact element prior to contact therebetween.

* * * * *